United States Patent [19]

Lincoln

[11] 4,108,525

[45] Aug. 22, 1978

[54] HERMAPHRODITIC EDGEBOARD CONNECTORS

[75] Inventor: Thomas Christopher Lincoln, Arcadia, Calif.

[73] Assignee: Microdot Inc., Greenwich, Conn.

[21] Appl. No.: 825,971

[22] Filed: Aug. 19, 1977

Related U.S. Application Data

[63] Continuation of Ser. No. 733,861, Oct. 19, 1976, abandoned.

[51] Int. Cl.[2] ..... H01R 25/02

[52] U.S. Cl. ..... 339/49 R; 339/60 M

[58] Field of Search ..... 339/47 R, 49 R, 59 M, 339/60 M, 61 M, 211

[56] References Cited

U.S. PATENT DOCUMENTS

| | | | |
|---|---|---|---|
| 2,521,822 | 9/1950 | Boswell | 339/49 R |
| 3,840,839 | 10/1974 | Smaczny et al. | 339/49 R |

FOREIGN PATENT DOCUMENTS

| | | | |
|---|---|---|---|
| 881,128 | 9/1971 | Canada | 339/47 R |

*Primary Examiner*—Neil Abrams

*Attorney, Agent, or Firm*—Harness, Dickey & Pierce

[57] ABSTRACT

The disclosure relates to a miniature high density connector. Like connector housings, termed "hermaphroditic" in the industry in that each contains male and female pins and sockets, are constructed and mated in a manner that maximizes electrical and mechanical integrity yet minimizes size. A pair of like, elongated insulated housings of generally U-shaped transverse cross section have a plurality of aligned closely spaced bores with male electrical contacts supported therein in one leg and a plurality of closely spaced tubular female contacts in the bight portion of each housing, the housings being adapted to mate with one another so that the male and female contacts are directly supported by the bores in one leg of each housing.

1 Claim, 8 Drawing Figures

12
76
78
72
18
66
62
64
24
42
60
70
2
3
4
1

HERMAPHRODITIC EDGEBOARD CONNECTORS

This is a continuation of application Ser. No. 733,861, filed Oct. 19, 1976, now abandoned.

BACKGROUND OF THE INVENTION

The trend towards miniaturization in the electronics industry is continuing resulting in the requirement for improved high density connectors. Known connectors utilizing 24 AWG contacts on 0.050 centers have proved to be too large for some applications raising a requirement for a new generation of 30 AWG contacts on smaller centers.

SUMMARY OF THE INVENTION

A connector in accordance with the present invention utilizes 30 AWG contacts on 0.025 centers. Since tolerance buildup problems increase proportionally with the decrease in contact center line dimensions, the pin and socket insulators are arranged side by side. Side walls protect the socket contact. Complimentary housing structure protects the pin and works cooperatively with the socket protection wall to provide scoop proofing. The pins and sockets are polarized, and hermaphroditic. Both connector halves are made from the same mold cavity. The connector can be used as a two-piece edgeboard connector, wire to board, or wire to wire with jackscrews. The insulator material is polyphenelyene sulfide rated to 500° F. By averting the use of semi-precious metals yet providing gold to gold interface, crimp termination resistance at 1 to 2 milliohms is well within normal limits.

Figure 7:
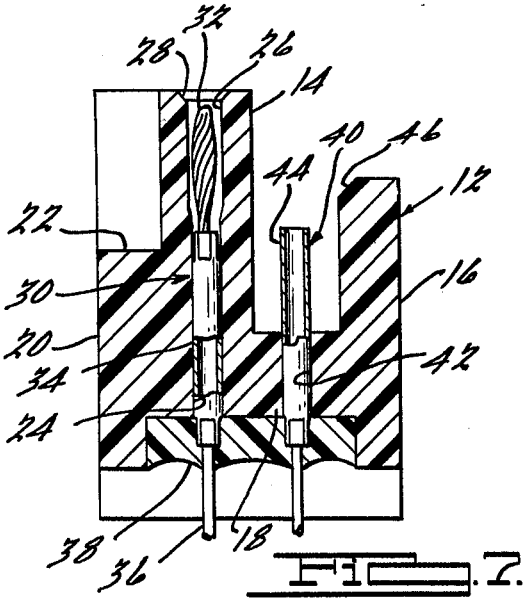
FIG. 7 is a cross-section view taken along the lines of 7—7 of FIG. 3.

A hermaphroditic connector 10 in accordance with the instant invention comprises a pair of like plastic housings 12 molded from, for example polyphenelyene sulfide. As best seen in FIG. 7, each connector portion 12 is of generally U-shaped transverse cross section defined by upstanding leg portions 14 and 16 connected by a bight portion 18. The leg portion 14 has a peripheral wall 20 with a recess 22 therein which, when a like connector portion 12 is assembled therewith, accommodates the opposite leg portion 16 of said like connector portion 12.

The leg portion 14 extends longitudinally of the connector portion 12 and is provided with a plurality of bores 24 which extend parallel to each other and to the wall 20 in closely spaced relation, for example, 0.025 inches center to center spacing.

The bores 24 have an enlarged end portion 26 for slidable acceptance of a mating female contact as will be described. In a constructed embodiment the bores 24 have a maximum diameter of 0.0185 inches and the enlarged portions 26 thereof have a maximum diameter of 0.0200 inches. The portion 26 of the bore 24 has a chamfer 28 at the end thereof to facilitate entry of the female contact.

A male contact 30 is disposed within the bore 24 and comprises, for example, a twisted wire termination 32 crimped in one end of a sleeve 34, a connecting wire 36 being crimped in the other end thereof. The sleeve 34 is secured within the bore 24 as by epoxy 38.

A socket 40 having an inside diameter complementary to the termination 32 is secured within a complementary bore 42 in the bight portion 18 of the housing 12. The bore 42 is of like dimension to the bore 24, the socket 40 being secured therein by the expoy layer 38. The socket 40 has an end portion 44 which extends above the bight portion 18 of the housing 12 a distance sufficient to effect good electrical contact with the termination 32 of the male contact 30 when two of the housings 12 are assembled with one another.

The other leg portion 16 of the housing 12 extends generally parallel to the leg 14 for protection and stabilization of the socket 40. The leg portion 16 is acceptable in the recess 22 in a like housing 12 when assembled therewith, a chamfer 46 thereon facilitating such assembly.

Figures 1, 2, 3, 4:
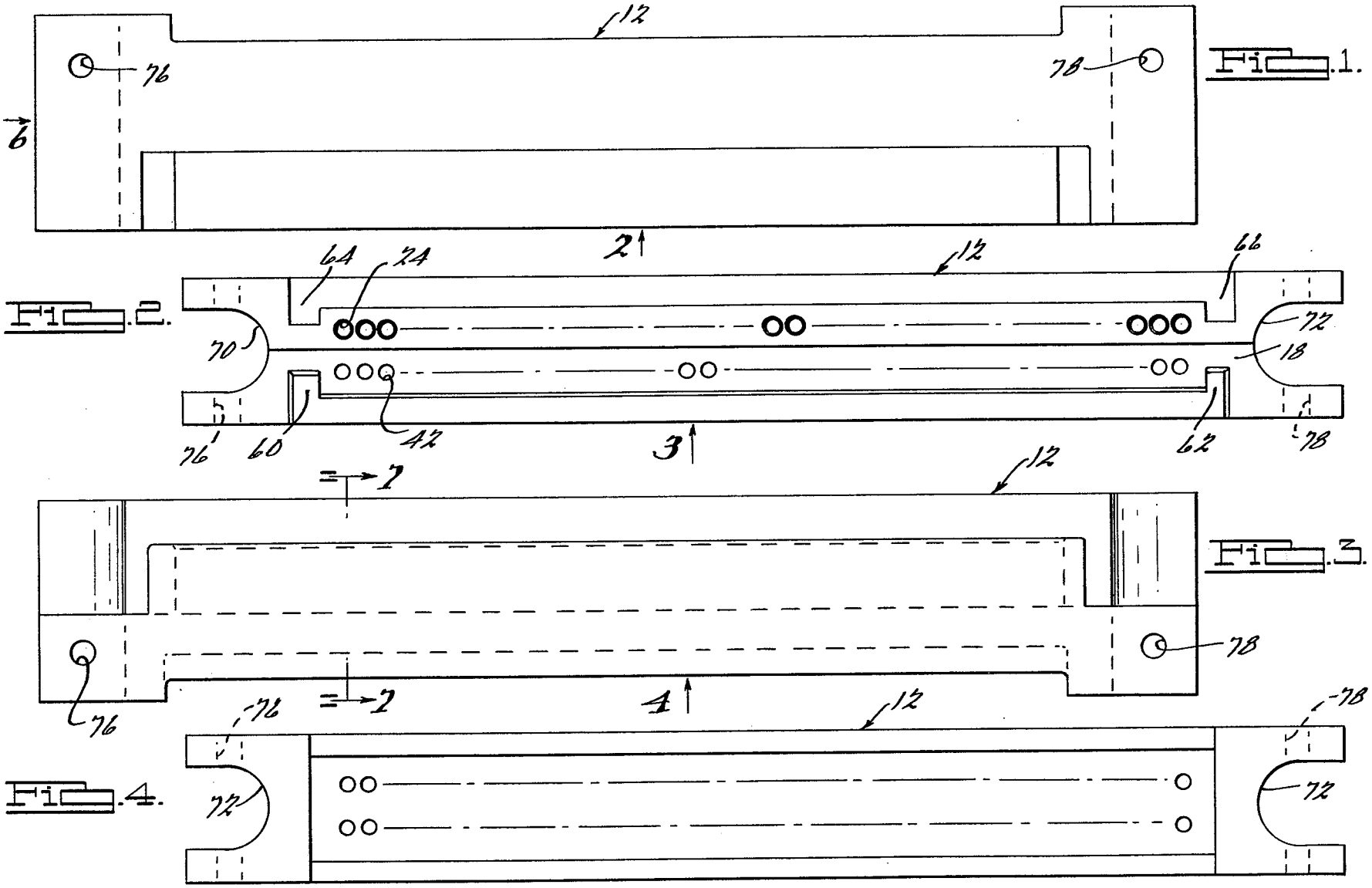
FIG. 1 is an elevational view of one side of a hermaphroditic connector housing in accordance with the instant invention.
FIG. 2 is a view taken in the direction of the arrow "2" of FIG. 1.
FIG. 3 is a view taken in the direction of the arrow "3" of FIG. 2.
FIG. 4 is a view taken in the direction of the arrow "4" of FIG. 3.
Figure 5:
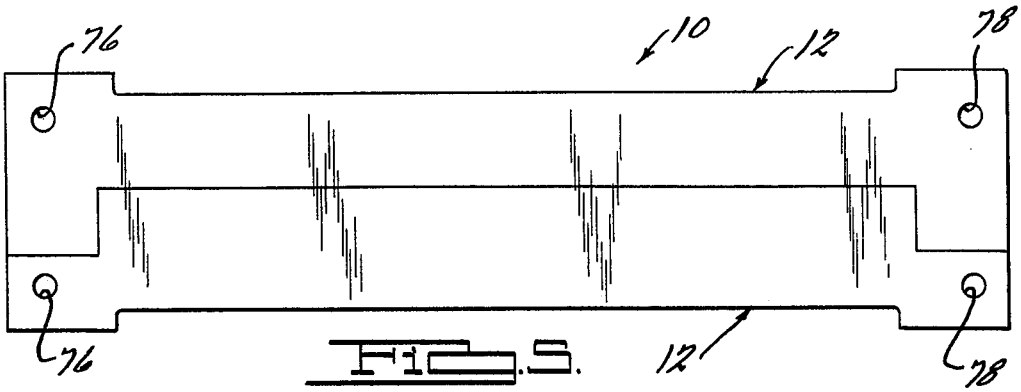
FIG. 5 is a side elevational view showing the connector portions of FIGS. 1 and 3 in the assembled condition.
Figure 6:
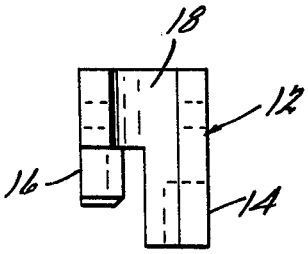
FIG. 6 is a view taken in the direction of the arrow "6" of FIG. 1.

As best seen in FIG. 2 of the drawings, each housing 22 is provided with end closures 60 and 62 at opposite ends of the bight portion 18 thereof. The end closures 60 and 62 are accepted in complementary slots 64 and 66 in the leg 14 of a mating housing 12 when the housings are assembled. The combination of the end closures 60 and 62 with the leg portions 14 and 50 effectively closes the ends of the bight portion 18 preventing the intrustion of foreign matter into the area of the male contact 30 and female socket 40.

As best seen in FIGS. 2 and 4, the housings 12 are provided with hemispherical cutouts 70 and 72 for the acceptance of conventional retaining screws or other devices. Appertures 76 and 78 are provided for the acceptance of conventional jack screws, if desired.

Figure 8:
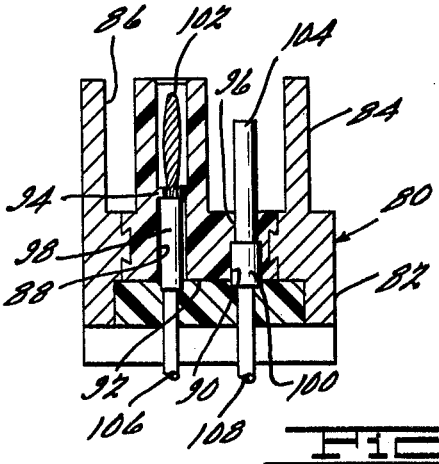
FIG. 8 is a view, similar to FIG. 7, of a modified connector enclosed in a metal shell.

As best seen in FIG. 8, a modified connector housing 80 is provided with a metal shell 82 one wall 84 of which functions as the equivalent of the leg 16 of the housing 12 in th all-plastic housing. The leg 84 is accepted in a complementary recess 86 in a like housing when two of the housings 80 are assembled with one another. It is also to be noted that bores 88 and 90 in a plastic center portion 92 of the housing 80 are provided with shoulders 94 and 96, respectively, for positively locating a pair of sleeves 98 and 100. The sleeves 98 and 100 serve to accommodate a twisted wire male termination 102 and a tubular female socket 104, connecting wires 106 and 108 being secured to opposite ends thereof to effect electrical connection in the conventional manner.

From the foregoing description it should be apparent that the instant invention provides an edgeboard 2 row connector that will mate with itself and using closed entry male and female contacts. Features include scoop proofing, polarizing, keying, closed ends, mating retention clips and options for hermaphroditic metal shells.

Whereas the housings used in the single gender connector assemblies require two different tools representing a larger capital investment to supply each layout; the connector housing of the instant invention requires only a single tool.

Because of differences in mass between single gender pin housings and socket housings, post mold material shrink affects part sizes. Such non-uniform shrinkage is eliminated by the instant invention since mating connectors are from the same mold cavity.

While it will be apparent that the invention herein disclosed is well calculated to achieve the benefits and advantages as hereinabove set forth, it will be appreciated that the invention is susceptible to modification, variation and change without departing from the spirit thereof.

I claim:

1. A miniature high density hermaphroditic electrical connector comprising a pair of like, elongated insulating housings each of which is of generally U-shaped transverse cross section having a first leg and a second leg and a bight portion, a plurality of longitudinally aligned closely spaced bores in said first leg of each housing, each of said bores having a chamfered end, a plurality of aligned cantilevered twisted wire male electrical contacts supported in said bores, respectively, said male contacts extending into close radially spaced relation to the walls of said bores and terminating short of the ends of said bores, respectively, as to be individually protected and maintained substantially in alignment with the central axis of said bores, a plurality of aligned closely spaced tubular female contacts in the bight portion of each housing extending parallel to the legs thereof, the bight portion of each housing having a transverse dimension complimentary to the width of said first leg for the acceptance thereof, each end of the bight portion of each housing having an end closure member extending therefrom and each end of said first leg having complimentary slots therein for the acceptance of end closure members of the other housing, said first leg of each housing having a recess therein for the acceptance of a second leg of the other housing, and said housings being adapted to mate with one another with said end closure members of each housing being received by said complimentary slots of the other housing, said second legs of each housing being received by said recess in said first leg of the other housing, and said first leg of each housing extending between the legs of the other housing whereby said male contacts are accepted in said female contacts when said housings are assembled and said male and female contacts are directly supported by the bores in said first leg of each housing.

* * * * *